US005601470A

United States Patent [19]

Yao

[11] Patent Number: 5,601,470

[45] Date of Patent: Feb. 11, 1997

[54] TOY BUILDING BLOCK PUZZLE

[76] Inventor: Li-ho Yao, No. 14, Lane 113, Hsiamen St., Taipei, Taiwan

[21] Appl. No.: 582,096

[22] Filed: Jan. 2, 1996

[51] Int. Cl.[6] ..... A63H 33/08; A63F 9/10

[52] U.S. Cl. ..... 446/127; 273/157 R

[58] Field of Search ..... 273/153 R, 156, 273/157 R, 157 A, 160; 434/172; 446/120, 121, 122, 123, 124, 125, 126, 127

[56] References Cited

U.S. PATENT DOCUMENTS

| | | | |
|---|---|---|---|
| 269,789 | 12/1882 | Jaeger | 273/157 R X |
| 1,531,542 | 3/1925 | Cogshall | 446/127 X |
| 2,472,363 | 6/1949 | Blackinton | 273/127 |
| 5,439,221 | 8/1995 | Harvie | 273/157 R |

FOREIGN PATENT DOCUMENTS

| | | | |
|---|---|---|---|
| 1490136 | 6/1967 | France | 446/121 |

*Primary Examiner*—William H. Grieb

*Attorney, Agent, or Firm*—Abelman, Frayne & Schwab

[57] ABSTRACT

A toy building block puzzle comprises a plurality of at least five differently shaped building blocks. Each block has a peripheral side wall which may include a plurality of lugs and recesses. The lugs and recesses are shaped and sized to interlock two or more blocks together in a horizontal plane by which puzzles of geometric and alphabetic configurations may be formed.

3 Claims, 3 Drawing Sheets

TOY BUILDING BLOCK PUZZLE

FIELD OF THE INVENTION

This invention relates to a toy building block puzzle comprising different shapes such as triangles and squares which inter-lock to define a further geometric shape, such as a parallelogram or triangle.

The prior art toy building blocks have many sizes and shapes but substantially are square or rectangular with protrusions extending from an upper face and cavities defined in a lower face to receive the protrusions of another block therein. However, such blocks are basically limited to a single plane interconnection., i.e., vertical. Furthermore, as such block are square or rectangular, with 90° corners, resulting constructions are limited to having 90° corners.

Thus, it is found that there is a long and unfulfilled need for a toy building element having regular and irregular geometric shapes, such as squares or triangles.

SUMMARY OF THE INVENTION

The present invention comprises a plurality of five individual building blocks and each block may have a 'C'-shaped lug, a 'C'-shaped recess or a combination thereof and each hereinafter respectively referred to as a "lug" or a "recess." A first block is shaped as a square and has a lug formed outwardly at a mediate point in two first opposite edges thereof and a corresponding recess, defined at a mediate point in each of two second opposite edges.

A second block is shaped as an isosceles triangle with a first edge having a lug formed outwardly at a mediate point thereof, and a recess defined at a mediate point in each of the remaining sides.

A third block is shaped as an isosceles triangle with a first edge having a lug formed outwardly at a mediate point thereof, a second edge having a second lug extending outwardly therefrom at a mediate point thereof, and a third edge with a recess defined at a mediate point thereof.

A fourth block is shaped as a truncated sector of a circle having three straight sides and an arcuate side, each side defining a recess in a mediate point thereof.

A fifth block is shaped as a truncated sector of a circle having three straight sides and an arcuate side wherein two opposing straight sides each have a lug outwardly formed at a mediate point thereof and the remaining straight side and arcuate side each have a recess defined in a mediate point thereof.

Each lug is sized and shaped to engage in a corresponding recess with an interference fit thus interlocking the blocks until a user requires them separated which can be done by applying an appropriate amount of force.

Other objects, advantages and novel features of the invention will become more apparent from the following description when taken in conjunction with the accompanying drawings.

DETAILED DESCRIPTION OF THE PREFERRED EMBODIMENT

Figure 1:
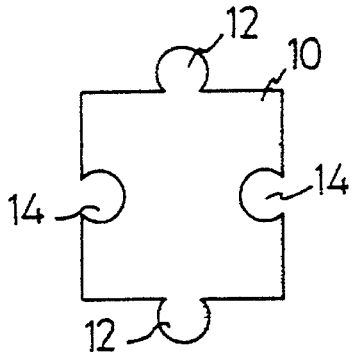
FIG. 1 shows a front view of a first toy building block in accordance with the present invention.

Referring to the drawings, a toy building block puzzle comprises at least five different toy building blocks (hereinafter referred to as blocks) each block being substantially hollow with an open bottom, a closed top wall, the top wall having a generally planar upper surface, and a plurality of side walls extending downwardly from the top wall.

Furthermore, each bloc may have a plurality of 'C'-shaped recesses and 'C'-shaped lugs which are sized and shaped to interlock with each other in an interference fit and each 'C' having an arc of more than 180°. Thus, the blocks may be interlocked by pushing one of the lugs into a corresponding recess whereby the blocks will remain interlocked due to the interference fit and 'C'-shape yet be detachable when a predetermined amount of force is applied.

Furthermore, the blocks are preferably made of plastics material which is suitable for injection moulding.

Referring to FIG. 1, a first bloc 10 is shaped as a square and has a pair of lugs 12, each lug 12 formed outwardly at a respective mediate point in two first opposite edges thereof and a pair of corresponding recesses 14, each recess 14 defined in a respective mediate point in two second opposite edges.

Figure 2:
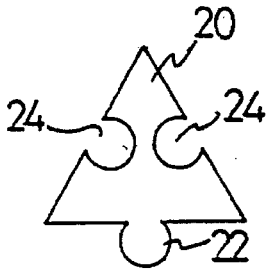
FIG. 2 shows a front view of a second toy building block in accordance with the present invention.

Referring to FIG. 2, a second block 20 is shaped as an isosceles triangle with a first edge having a lug 22 formed outwardly at a mediate point thereof and a second and a third edge each having a recess 24, defined at a mediate point thereof.

Figure 3:
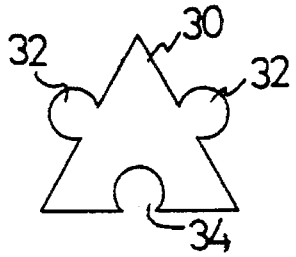
FIG. 3 shows a front view of a third toy building block in accordance with the present invention.

Referring to FIG. 3, a third block 30 is shaped as an isosceles triangle with a first and a second edges each having a lug 32 formed outwardly at a respective mediate point thereof, and a third edge with a recess 34 defined in a mediate point thereof.

Figure 4:
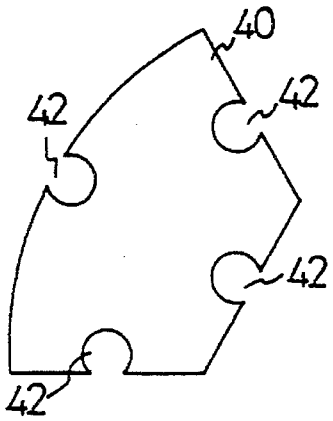
FIG. 4 shows a front view of a fourth toy building block in accordance with the present invention.

Referring to FIG. 4, a fourth block 40 is shaped as a truncated sector of a circle, having three straight sides and an arcuate side, each side defining a recess 42 in a respective mediate point thereof.

Figure 5:
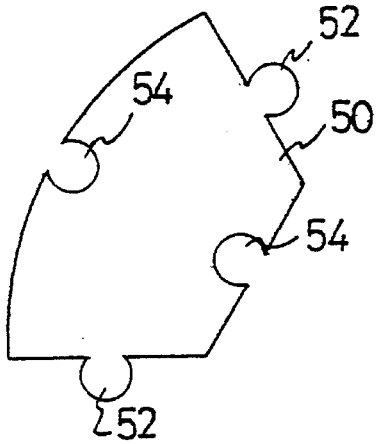
FIG. 5 shows a front view of a fifth toy building block in accordance with the present invention.
Figure 9:
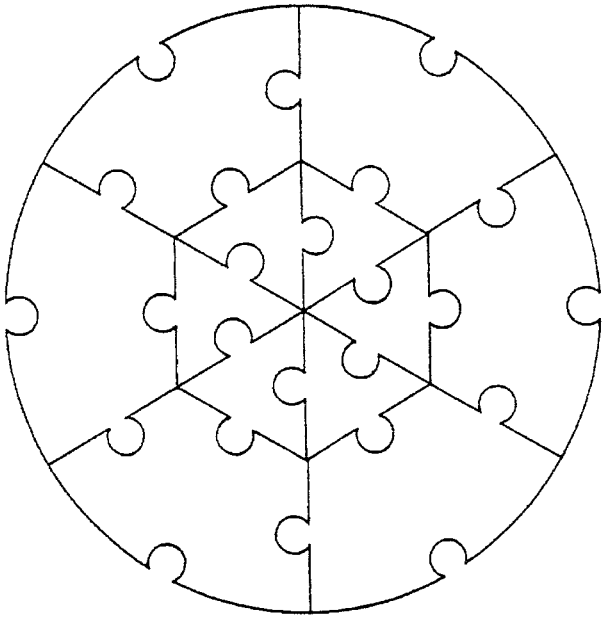
FIGS. 6 through 13 show the toy building blocks of the present invention in a variety of assemblies.
Figure 8:
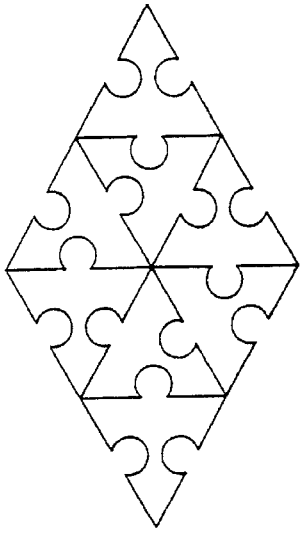
Figure 7:
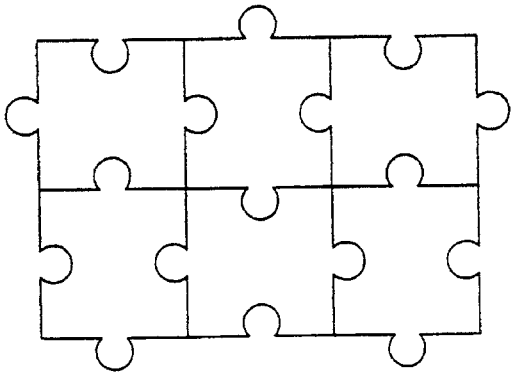
Figure 6:
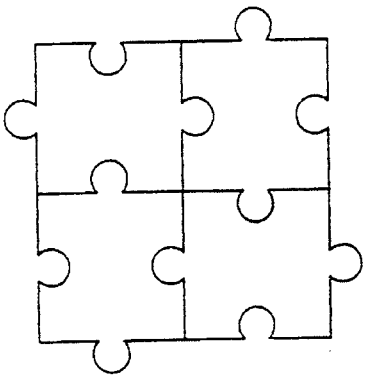
Figure 10:
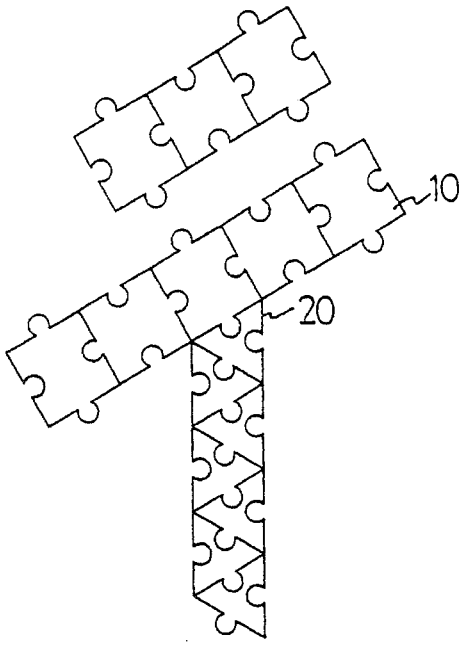
Figure 11:
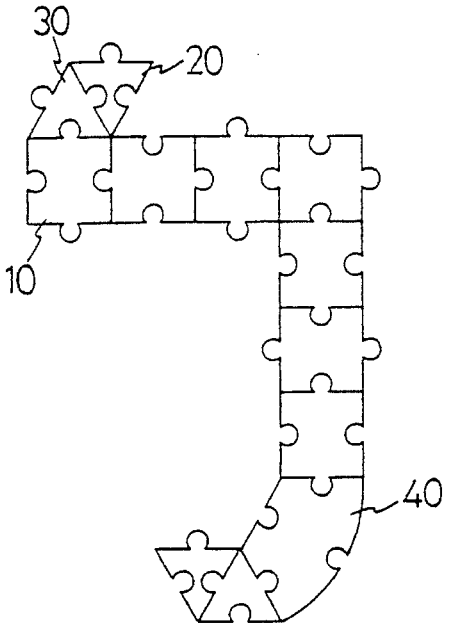
Figure 12:
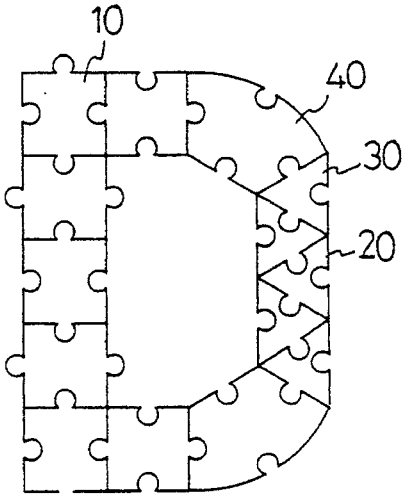
Figure 13:
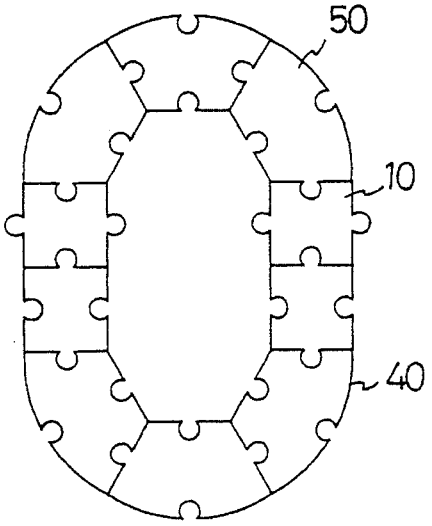

Referring to FIG. 5, a fifth block 50 is shaped as a truncated sector of a circle, having three straight sides and an arcuate side, the opposing straight sides each have a lug 52 outwardly formed at a respective mediate point thereof and the remaining straight side and arcuate side each have a recess 54 defined in a respective mediate point thereof.

It is to be noted that each straight edge of each block is of a same length.

Building blocks of the present invention provide novelty in the configuration of geometric and alphabetic shapes as shown in FIGS. 6 through 13.

Although the present invention has been explained in relation to its preferred embodiments, it is to be understood that many other possible modifications and variations can be made without departing from the spirit and the scope of the invention as hereinafter claimed.

What the invention claimed is:

1. A toy construction block puzzle comprising:

a plurality of at least three different shaped and interconnectible toy building elements, each toy building element comprising a hollow block having a closed upper end, an open lower end, and a peripheral side wall interconnecting the lower and upper ends, with at least one recess defined in the peripheral side wall, at least one lug, extending outwardly from the peripheral side wall, the lug and recess being dimensioned and shaped to press fit together thereby interlocking a plurality of blocks together in a horizontal plane;

the peripheral side walls of a first of said elements being shaped as a square with a pair of lugs extending outwardly from a respective mediate point of each of two first opposing straight sides and a pair of recesses, each recess defined in a respective mediate point of each of two second opposing straight sides;

the peripheral side walls of a second of said elements being shaped as an isosceles triangle with one lug extending from a mediate portion of one straight side and a recess defined in a respective mediate portion of each of the two remaining straight sides; and the peripheral side walls of a third of said elements being shaped as a truncated sector of a circle, having a first straight edge, a second and third straight edges which oppose each other and are non-parallel, and an arcuate edge opposing the first straight edge.

2. A toy construction block puzzle comprising:

a plurality of toy building elements, each toy building element comprising a hollow block having a closed upper end, an open lower end, and a peripheral side wall interconnecting the lower and upper ends, with at least one recess defined in the peripheral side wall, at least one lug, extending outwardly from the peripheral side wall, the lug and recess being dimensioned and shaped to press fit together thereby interlocking a plurality of blocks together in a horizontal plane;

the peripheral side wall of at least one of said elements being shaped as a truncated sector of a circle, thereby defining a first straight edge, a second and third straight edges which oppose each other and are non-parallel, and an arcuate edge opposing the first straight edge, wherein the first, second and third straight edges and the arcuate edge each have a recess defined in a respective mediate point thereof.

3. A toy construction block puzzle comprising:

a plurality of toy building elements, each toy building element comprising a hollow block having a closed upper end, an open lower end, and a peripheral side wall interconnecting the lower and upper ends, with at least one recess defined in the peripheral side wall, at least one lug, extending outwardly from the peripheral side wall, the lug and recess being dimensioned and shaped to press fit together thereby interlocking a plurality of blocks together in a horizontal plane;

the peripheral side wall of at least one of said elements being shaped as a truncated sector of a circle, thereby defining a first straight edge, a second and third straight edges which oppose each other and are non-parallel and an arcuate edge opposing the first straight edge, wherein the second and third straight edges each have a lug extending outwardly from a respective mediate point thereof and the first straight edge and the arcuate edge each have a recess defined in a respective mediate point thereof.

* * * * *